US007540153B2

(12) United States Patent
Tanimura et al.

(10) Patent No.: US 7,540,153 B2
(45) Date of Patent: Jun. 2, 2009

(54) COMBUSTOR

(75) Inventors: Satoshi Tanimura, Takasago (JP); Kenta Kurihara, Takasago (JP); Toshihiko Saitoh, Takasago (JP); Jose Rodriguez, Miami, FL (US)

(73) Assignee: Mitsubishi Heavy Industries Ltd., Tokyo (JP)

( * ) Notice: Subject to any disclaimer, the term of this patent is extended or adjusted under 35 U.S.C. 154(b) by 502 days.

(21) Appl. No.: 11/362,529

(22) Filed: Feb. 27, 2006

(65) Prior Publication Data

US 2007/0199327 A1 Aug. 30, 2007

(51) Int. Cl.
*F23R 3/16* (2006.01)
*F23R 3/54* (2006.01)

(52) U.S. Cl. ..... 60/737; 60/747; 60/748

(58) Field of Classification Search ..... 60/737, 60/746, 747, 748, 760
See application file for complete search history.

(56) References Cited

U.S. PATENT DOCUMENTS 5,274,991 A * 1/1994 Fitts ..... 60/737
6,594,999 B2 * 7/2003 Mandai et al. ..... 60/760
6,634,175 B1 10/2003 Kawata et al.
6,923,001 B2 * 8/2005 Laster et al. ..... 60/750
2001/0020364 A1 * 9/2001 Sato et al. ..... 60/746
2004/0079082 A1 * 4/2004 Bunker ..... 60/752

FOREIGN PATENT DOCUMENTS

CA 2 340 107 A1 12/2000
JP 2000-346361 A 12/2000

* cited by examiner

*Primary Examiner*—Ted Kim
(74) *Attorney, Agent, or Firm*—Westerman, Hattori, Daniels & Adrian, LLP.

(57) ABSTRACT

By installing a cylinder 53*x* having a bell-mouth construction to the downstream side of a combustor basket 2*a* and by providing different level to the downstream-side end of the cylinder 53*x*, notches 60 are constructed. The notches 60 form fixed vortices in the compressed air, and the vortices enable the compressed air to determine the flow direction thereof so as to flow toward the tips of the main nozzles 22.

5 Claims, 10 Drawing Sheets

COMBUSTOR

BACKGROUND OF THE INVENTION

1. Field of the Invention

The present invention relates to a gas turbine combustor, and especially, relates to a combustor which is so constructed as to reduce drift and disturbance of airflow flowing through the interior thereof.

2. Description of the Prior Art

A cross-sectional view of FIG. 12 shows a general construction of a gas turbine. As shown in FIG. 12, a gas turbine comprises a compressor 1 compressing the air; combustors 2 being supplied with the air compressed by the compressor 1 and fuels so as to perform combustion; and a turbine 3 being rotary driven by combustion gas from the combustors 2. The compressor 1, the combustors 2 and the turbine 3 are covered by casings 4, respectively. In addition, a plurality of the combustors 2, sixteen pieces for example, are arranged on the outer circumference of a rotor 5 serving as one shaft sharing the compressor 1 and the turbine 3, being equally spaced.

In a gas turbine as described hereinabove, the air compressed by the compressor 1 is supplied to the combustors 2 and the rotor 5 through the interior of the casing 4. Then, the compressed air being supplied to the combustors 2 are used for combustion of fuels being supplied to the combustors 2. In addition, the compressed air being supplied to the interior of the casing 4 and the rotor 5 of the turbine 3 is used for cooling stationary vanes 31 fixed to the casing 4 and rotating blades 32 fixed to the rotor 5 both of which are exposed to high temperature due to combustion gas.

A combustor 2 being provided to such a gas turbine as constructed hereinabove comprises a combustor basket 2*a* being provided to the fuel-supply side; a transition piece 2*b* being connected to the combustor basket 2*a* and injecting combustion gas to the stationary vanes 31 in a first row of the turbine 3; and an external cylinder 2*c* being inserted so as to be along the inner wall of the casing 4 and covering the combustion basket 2*a*. Moreover, FIG. 13 shows an enlarged cross-sectional view depicting the vicinity of the combustor 2 in order to describe a detailed construction of the vicinity of the combustor 2.

As shown in FIG. 13, the combustor 2 has a combustor basket 2*a* comprise a pilot nozzle 21 being provided to the center thereof and performing diffusion combustion; a plurality of main nozzles 22 being provided to the outer circumference of the pilot nozzle 21, equally spaced, and performing premixed combustion; a pilot cone 23 being provided so as to cover the downstream-side tip of the pilot nozzle 21; and main burners 24 being provided so as to cover the downstream-side tips of the main nozzles 22. In addition, the compressor 1 is provided with a compressor outlet 11 for supplying the compressed air to the interior of the casing 4 where the combustor 2 is inserted, and the compressed air discharged from the compressor outlet 11 is supplied to the interior of the combustor basket 2*a*.

Moreover, in order to describe the detailed construction of a combustor 2, FIG. 14 shows an enlarged cross-sectional view of a combustor basket 2*a* of a combustor 2. As shown in FIG. 14, a combustor 2 comprises a pilot swirl 25 being installed so as to be in contact with the outer circumference of the pilot nozzle 21 on the upstream side inside the pilot cone 23 and main swirls 26 being installed so as to be in contact with the outer circumference of the main nozzles 22 on the upstream side inside the main burners 24. As a result, the air being supplied to the pilot cone 23 is made uniform in the pilot swirl 25 and at the same time, the air being supplied to the main burners 24 is made uniform in the main swirls 26.

Additionally, the combustor 2 has a plurality of supports 27 provided to the outer circumference of the combustor basket 2*a* on the upstream side thereof and a rib 29 provided to support a punched metal plate 28 consisting of a perforated plate being provided to the entrance to a space between the external cylinder 2*c* and the combustor basket 2*a* on the downstream side. By having the support 27 and the rib 29 connected to the external cylinder 2*c* and the combustor basket 2*a*, the combustor basket 2*a* is supported and fixed to the external cylinder 2*c*. Furthermore, on the downstream side of the pilot nozzle 21, the main nozzles 22 are fixed by having supports 30 provided to connect the outer circumference of the pilot nozzle 21 to the main nozzles 22.

For a combustor 2 being constructed as described hereinabove, the compressed air being discharged from the compressor outlet 11 to the interior of the casing 4 flows into a space formed between the external cylinder 2*c* and the combustor basket 2*a* by way of the punched metal plate 28. The punched metal plate 28 plays a role of uniformizing the compressed air flowing into the combustor 2 by being made of a perforated plate so as to provide resistance. The compressed air flowing into the space between the external cylinder 2*c* and the combustor basket 2*a* by way of the punched metal plate 28 flows along the inner wall of the external cylinder 2*c*.

In consequence, by having the compressed air make 180 degrees turn at the bottom part of the external cylinder 2*c* (the bases of the pilot nozzle 21 and the main nozzles 22), the compressed air flows in between the supports 27 supporting the combustor basket 2*a* and is supplied to the interior of the combustor basket 2*a*. Then, finally, a swirling flow is supplied by the pilot swirl 25 and the main swirls 26 of the combustor 2 so as to be used for diffusion combustion by the pilot nozzle 21 and used for premixed combustion by the main nozzles 22.

However, the compressed air being supplied to the combustor 2 in a manner as described hereinabove becomes unstable in flowing inside the combustor 2. To be specifically, a vortex flow due to flow separation is generated on the inner wall of the combustor basket 2*a* serving as the outside of the main nozzles 22, and a vortex flow due to turning of the flow of the compressed air is generated on the base of the pilot nozzle 21, respectively. In addition, a vortex flow flowing along the pilot nozzle 21, a vortex flow flowing along the inner wall of the combustor basket 2*a* toward the outlet of the combustor basket 2*a* and the like are also generated. Due to these vortex flows, the flow of the compressed air inside the combustor basket 2 becomes unstable.

As a result, pressure distribution of the compressed air at the tips of the pilot nozzle 21 and the main nozzles 22 becomes imbalanced, resulting in unstable combustion thereof. In consequence, not only the rate of occurrence of NOx becomes high but also durability becomes deteriorated due to generation of combustion oscillations. For these disadvantages, the present applicant proposes a combustor in which disturbance and drift of the compressed air flow are restrained by installing a flow ring having a semicircular cross-sectional configuration and a ring shape to a position where the supports 27 are connected to the combustor basket 2*a*. (See the Japanese Patent Application Laid-Open No. 2000-346361.)

In the Japanese Patent Application Laid-Open No. 2000-346361, it is disclosed that by installing a punched metal plate between the outside of the pilot nozzle 21 and the inside of the main nozzles 22 so as to provide resistance, uniformity of the compressed air flow flowing inside the combustor basket 2*a* is maintained. In addition, it is disclosed that by installing guide vanes nearer to the base side of the pilot nozzle 21 than a flow ring, the uniformity of the flow is maintained when the compressed air turns 180 degrees.

Being constructed as described hereinabove, it is possible to relatively stabilize the compressed air flow which flows, making 180 degrees turn inside the combustor basket 2*a*. However, because a difference occurs between the inside compressed air flow and the outside compressed air flow in turning, the uniformity thereof is not sufficient. As a result, it is necessary to compensate the uniformity by lengthening the distance from the position of the flow ring to the tip of the pilot nozzle 21 and the distance from the position of the flow ring to the main nozzles 22, respectively.

Therefore, not only the combustor 2 needs to be enlarged but also supports 30 are necessary to fix the tips of the main nozzles 22, but the supports 30 disturb the flow of the compressed air. To be specific, the supports 30 fixing the tips of the main nozzles 22 contribute to deterioration of uniformity of the flow of the compressed air inside the combustor 2. In addition, not only because the supports 30 give an adverse effect to uniformity of the compressed air flow inside the combustor 2 but also because the bottom portion (back surface side) of the external cylinder 2*c* is not constructed for purpose of turning at the position where the compressed air turns 180 degrees, instability of the flow in the external cylinder 2*c* is not eliminated. Moreover, there arises a problem of a significant pressure drop because resistance based on bending of the flow ring and guide vanes is significant.

SUMMARY OF THE INVENTION

It is an object of the present invention to provide a combustor which can uniformize the flow of compressed air flowing toward tips of main nozzles and minimize disturbance thereof.

A combustor in accordance with the present invention comprises:

a pilot nozzle being provided to the center of axis of the combustor and performing diffusion combustion:

main nozzles being provided circumferentially, equally spaced, on the side of the outside-circumference of the pilot nozzle and performing premixed combustion;

a combustor basket covering the sides of the outside circumferences of the pilot nozzle and the main nozzles;

a cylinder being connected to the ends on the side of the bases of the main nozzles of the combustor basket, having outside wall thereof upcurved from the side of the tips of the main nozzles toward the side of the bases of the main nozzles and having the tips on the side of the bases of the main nozzles formed in semicircular cross-sectional configuration;

an external cylinder being provided to the side of the outside circumferences of the combustor basket and the cylinder and serving as a passageway of compressed air between inside wall thereof and outside walls of the combustor basket and the cylinder, respectively;

notches being formed at the tips on the side of the bases of the main nozzles of the cylinder by providing a slot having a different level to a position corresponding to an intermediate position between the two adjacent main nozzles.

In accordance with the present invention, by providing notches at the tip of the cylinder, vortices are generated in the air flow by the tangential cus/protuberances and the vortices can be fixed. Then, the vortices being generated in the air flow can determine the direction of the air flow so as to flow toward the tips of the main nozzles. As a result, the air flow flowing toward the tips of the main nozzles can be stabilized. In addition, because a high pressure compressed air is supplied to the combustor, vortices being generated by the notches become small, which enables suppression of instability and pressure loss of the flow due to the vortices.

DESCRIPTION OF THE PREFERRED EMBODIMENTS

First Embodiment

Figure 1:
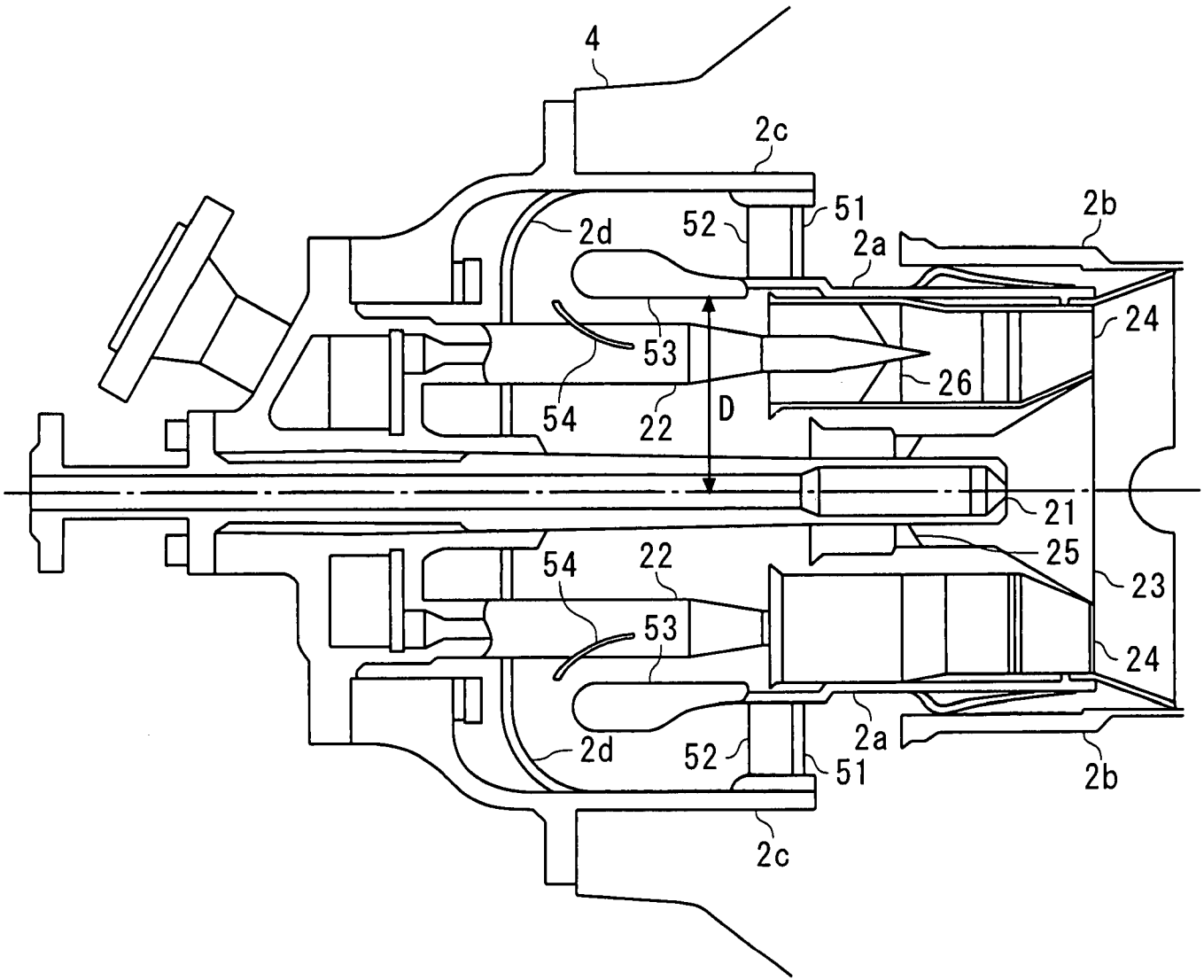
FIG. 1 is a cross-sectional view showing a construction of an interior of a combustor basket in a combustor in accordance with a first embodiment of the prevent invention.

Referring now to the drawings, a first embodiment of the present invention will be described hereinafter. FIG. 1 is a schematic cross-sectional view showing a construction of an interior of a combustor basket in a combustor in accordance with the prevent embodiment. In the construction of a combustor of FIG. 1, same symbols will be supplied to portions that are used for same purpose as combustors shown in FIG. 13 and FIG. 14, and detailed explanation thereof will be omitted. In addition, the side of a transition piece inside a combustor basket will be referred as "downstream side," while the side of a transition piece in a space between an external cylinder and a combustor basket will be referred as "upstream side."

Figure 13:
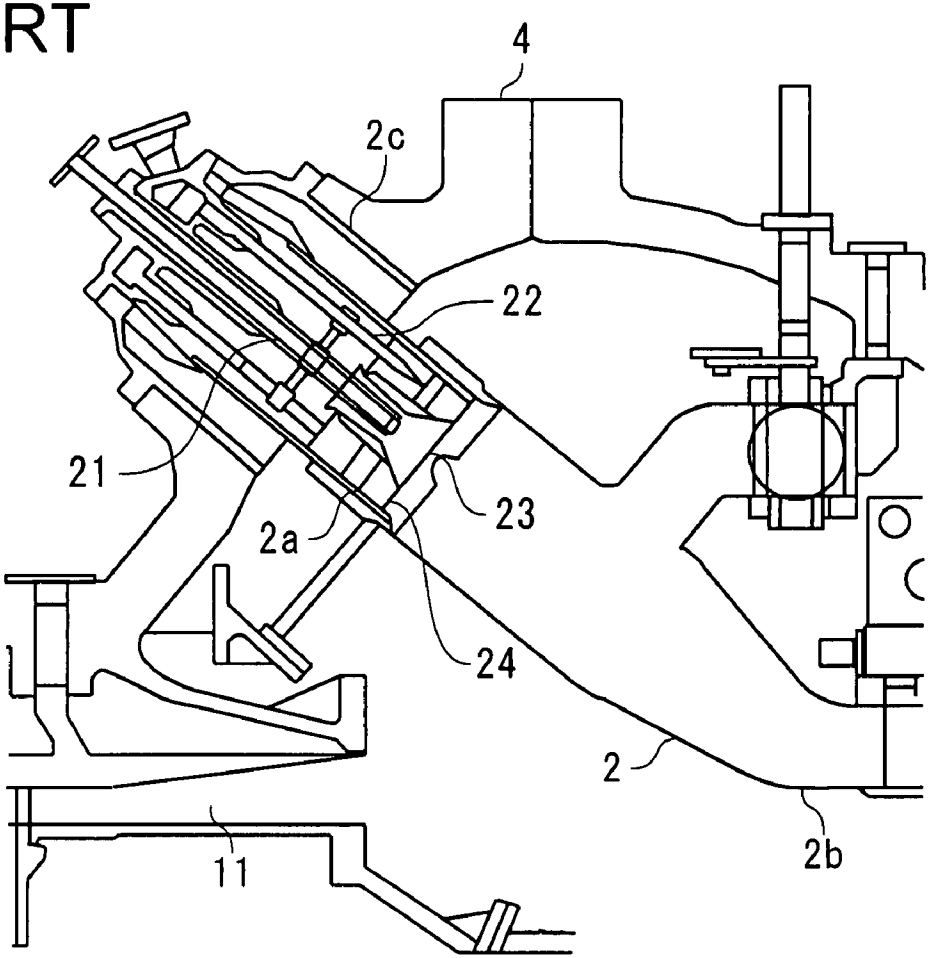
FIG.13 PRIOR ART
FIG. 13 is an enlarged cross-sectional view of a combustor of a conventional gas turbine.
Figure 14:
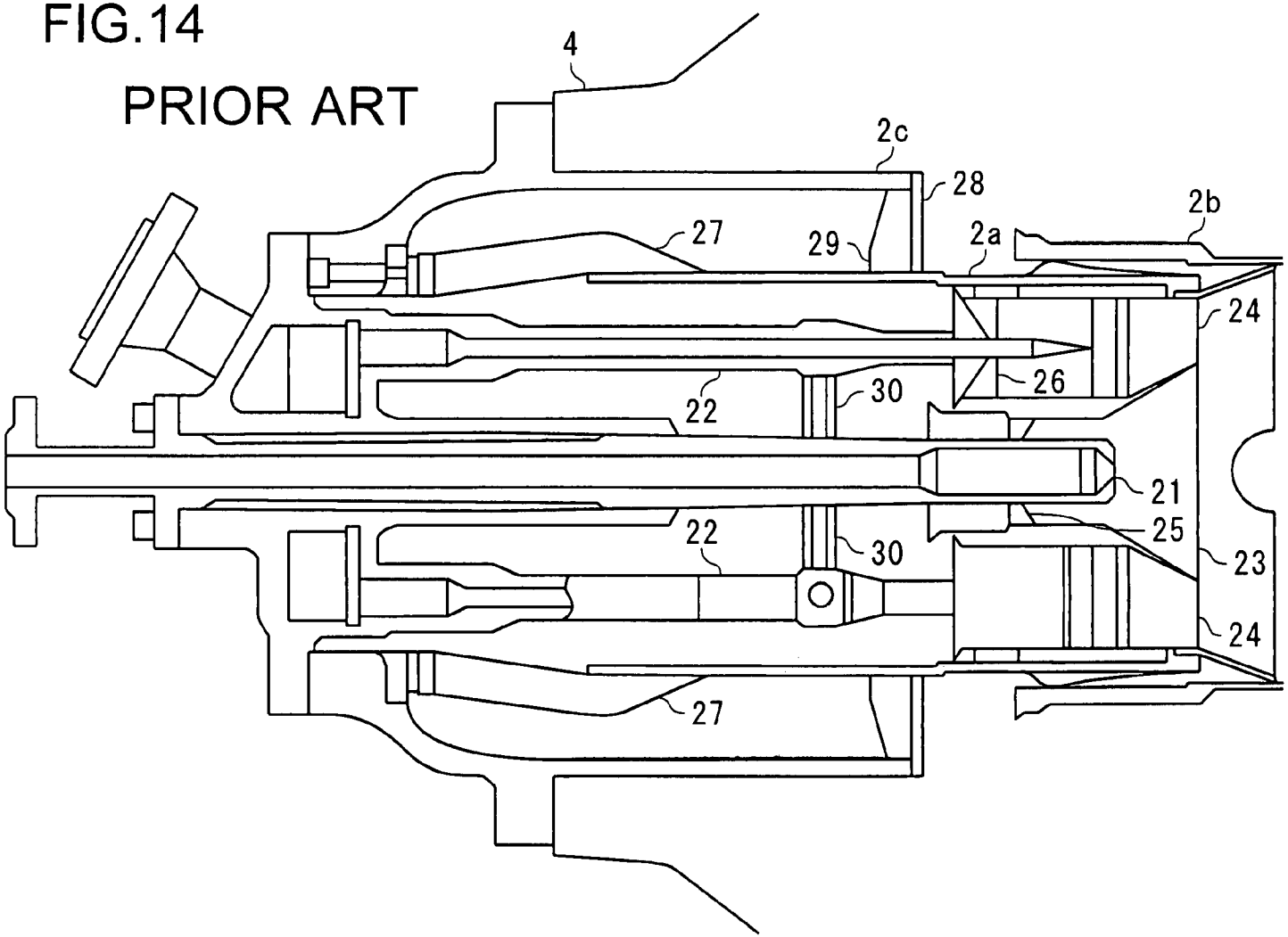
FIG.14 PRIOR ART
FIG. 14 is an enlarged cross-sectional view of a combustor basket of a combustor of a conventional gas turbine.

As shown in FIG. 1, same as a combustor of FIG. 13, a combustor in accordance with the present embodiment comprises a pilot nozzle 21 being provided to a center thereof and performing diffusion combustion; a plurality of main nozzles 22 being provided circumferentially to the outside circumference of the pilot nozzle 21, equally spaced, and performing premixed combustion; a pilot cone being provided so as to cover the tip of the pilot nozzle 21; main burners 24 being provided so as to cover the tips of the main nozzles 22; a pilot swirl 25 being installed between the outside wall of the pilot nozzle 21 and the inside wall of the pilot cone 23; and main swirls 26 being provided between the outside walls of the main nozzles 22 and the inside walls of the main burners 24.

Figure 12:
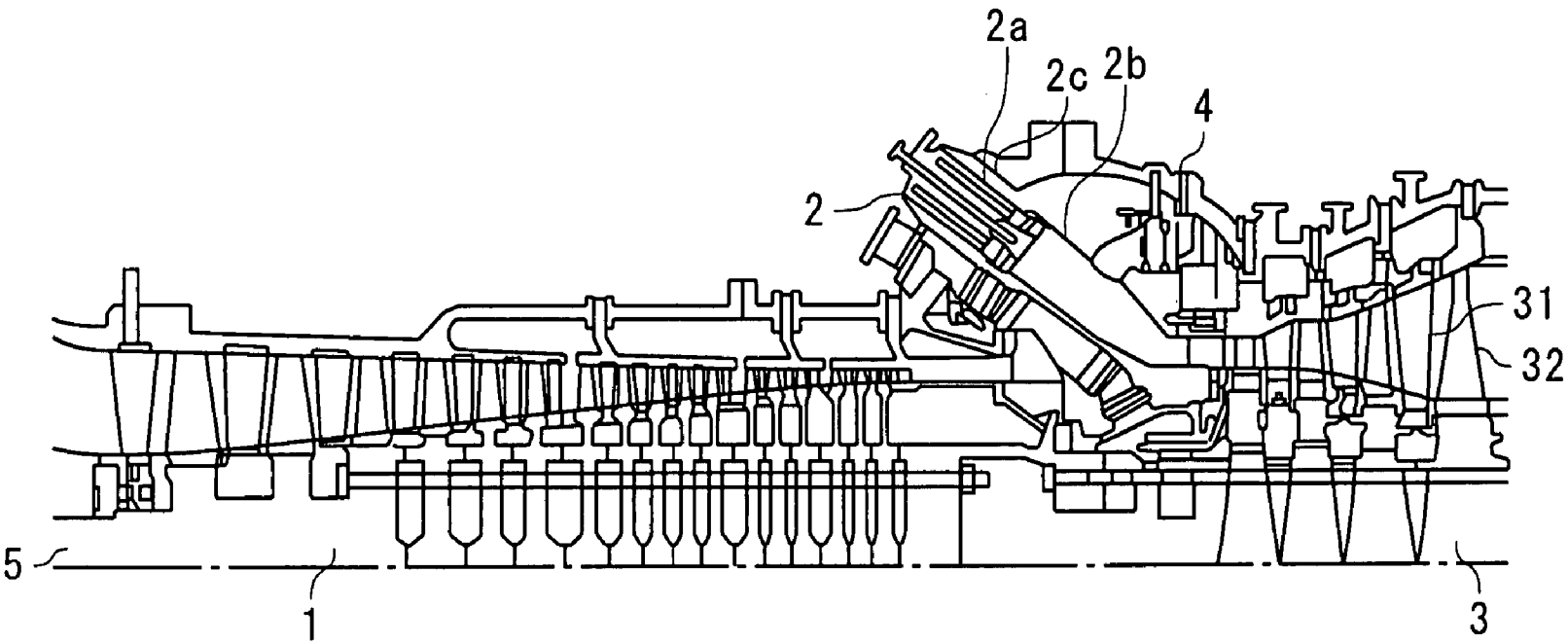
FIG. 12 is a schematic cross-sectional view showing a construction of a general gas turbine.

Then, a combustor shown in FIG. 1 comprises a combustor basket 2*a* being formed so as to cover the pilot nozzle 21 and the main nozzles 22; a transition piece 2*b* being engaged to the combustor basket 2*a* and introducing combustion gas from the pilot nozzle 21 and the main nozzles 22 to the gas turbine 3 (See FIG. 12.); a external cylinder 2*c* covering the outside circumference of the combustor basket 2*a* and at the same time being in contact with the inside wall of the casing 4; and a back surface wall 2*d* closing the downstream of the external cylinder 2*c*. In addition, the combustor, being different from a conventional combustor, is provided with a punched metal plate 51 being a perforated plate in a ring shape, covering the upstream side of the external cylinder 2*c* in a space between the combustor basket 2*a* and the external cylinder 2*c*; a rib 52 supporting the punched metal plate 51 and being connected to the combustor basket 2*a* and the external cylinder 2*c*; a cylinder 53 being connected to the upstream side of the combustor basket 2*a* and having a bell-mouth construction being provided with a bulb formed toward the external cylinder 2*c*; and turning vanes 54 in a ring shape being installed in the vicinity of the upstream-side end of the cylinder 53 so as to cover the spaces between the main nozzles 22.

In a combustor being constructed as described hereinabove, a plurality of main burners 24 are connected circumferentially to the downstream-side of the inside wall of the combustor basket 2*a*, being equally spaced, and a pilot cone 23 is installed to the center of the combustor basket 2*a* so as to have a close contact with each of the main burners 24. As a result, the pilot cone 23 and the main burners 24 are fixed to the downstream side of the combustor basket 2*a*. On the contrary, a cylinder 53 is connected to the upstream-side tip of the combustor basket 2*a* in a manner that an inside wall of the cylinder 53 is formed to be a same wall surface as the inside wall of the combustor basket 2*a* at the upstream-side end of the combustor basket 2*a*, thereby fixing a cylinder 53.

Then, a punched metal 51 is connected to the outside wall of the combustor basket 2*a* and the inside wall of the external cylinder 2*c* so as to cover the upstream-side of the external cylinder 2*c*, and a plurality of ribs 52 fixing the punched metal 51 are provided circumferentially, equally spaced. By having the ribs 52 connected to the outside wall of the combustor basket 2*a* and the inside wall of the external cylinder 2*c*, the combustor basket 2*a* is fixed to the inside of the external cylinder 2*c*. In addition, a pilot nozzle 21 is inserted into the center of the back surface wall 2*d* and main nozzles 22 are inserted circumferentially around the pilot nozzle 21, equally spaced. Then, by having a turning vane 54 connected to two adjacent main nozzles 22, turning vanes 54 are installed circumferentially to the spaces between the main nozzles 22. The back surface wall 2*d* where the pilot nozzle 21 and the main nozzles 22 are inserted is installed from the upstream-side of the external cylinder 2*c*.

By having the back surface wall 2*d* engaged to the external cylinder 2*c* and fixed as described hereinabove, the upstream sides of the pilot nozzle 21 and the main nozzles 22 are supported by the back surface wall 2*d* so that the pilot nozzle 21 and the main nozzles 22 are inserted into the inside of the combustor basket 2*a*, respectively. In addition, in order that the outside wall at the downstream-side tip of the pilot nozzle 21 is in close contact with the inside wall of the pilot swirl 25 of the pilot cone 23, the pilot nozzle 21 is inserted into the pilot swirl 25, which supports the downstream side of the pilot nozzle 21. In the same manner, in order that the outside wall at the downstream-side tips of the main nozzles 22 are in close contact with the inside walls of the main swirls 26, the main nozzles 22 are inserted into the main swirls 26, which support the downstream-side tips of the main nozzles 22.

(Construction of the Back Surface Wall, Cylinder and Turning Vanes)

Figure 2:
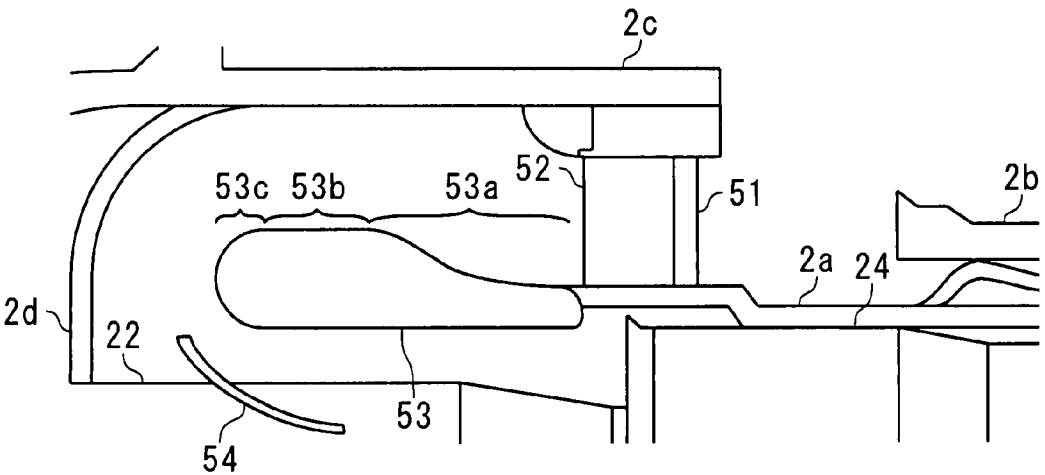
FIG. 2 is a cross-sectional view showing a construction of a cylinder of a combustor of FIG. 1.

Now, the construction of the back surface walls 2*d*, the cylinders 53 and turning vanes 54 of the combustor in FIG. 1 will be described hereafter. As described above, the construction is a bell-mouth construction that the outside-wall side of the cylinder 53 is upcurved toward the external cylinder 2*c*. As shown in a cross-sectional view of FIG. 2, the cylinder 53 having the bell-mouth construction is provided with a tapered portion 53*a* where the distance to the inside wall of the external cylinder 2*c* from the upstream-side tip thereof to the downstream-side thereof becomes shorter; a flat portion 53*b* where the distance to the inside wall of the external cylinder 2*c* on the downstream side of the tapered portion 53*a* is uniform; and a semi-circular portion 53*c* where the downstream-side end has a cross section in approximately semicircle configuration. In addition, the portion where inclination on the upstream side of the tapered portion 53*a* starts and the portion where the tapered portion 53*a* and the flat portion 53*b* are connected to each other are shaped so as to be smoothly rounded.

By having the cylinder 53 constructed as described hereinabove, the outside wall of the cylinder 53 is constructed so as to come close to the inside wall of the external cylinder 2*c* toward the downstream side. Therefore, a cross-sectional area of a passageway of compressed air being formed between the inside wall of the external cylinder 2*c* and the outside wall of the cylinder 53 is gently narrowed. As a result, the compressed air flow is throttled and uniformity in the circumferential direction of a combustor against the downstream-side flow of the cylinder 53 is achieved. In addition, by having the tapered portion 53*a* of the cylinder 53 formed so as to be gently upcurved like a bulb, the compressed air flowing through the punched metal plate 51 can be prevented from separation.

Figure 3:
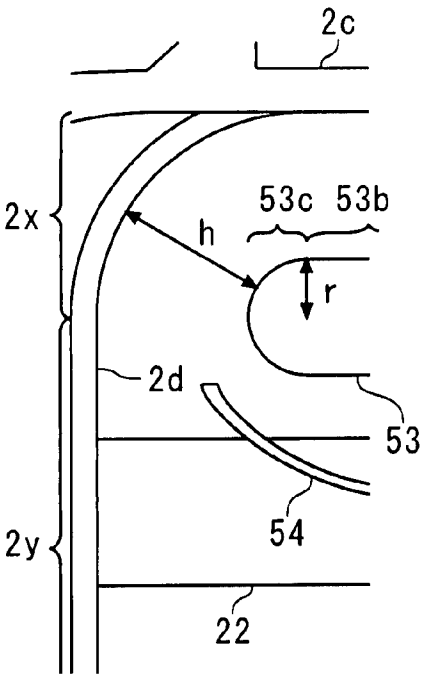
FIG. 3 is a cross-sectional view showing a construction of a back surface wall of a combustor of FIG. 1.

Additionally, as shown in the cross-sectional view in FIG. 3, the back surface wall 2*d* is constructed in such a manner as the side of the outside circumference of the cylinder 53 being a curved surface serves as an arc-shaped portion 2*x*, and the side of the inside circumference of the cylinder 53 being flat serves as a flat portion 2*y*, thereby making the inside wall surface thereof be a concave surface having a mortar shape. Wherein, the curvature of the arc-shaped portion 2*x* corresponds to the curvature of the outside circumference of the semicircle-shaped portion 53*c* of the cylinder 53, and the distance between the inside wall surface of the arc-shaped portion 2*x* of the back surface wall 2*d* and the outside wall surface of the semicircle-shaped portion 53*c* of the cylinder 53 becomes constant. In addition, the connected portion of the arc-shaped portion 2*x* to the flat portion 2*y* in the back surface wall 2*d* is formed on an axial extension line from the downstream-side end of the semicircle-shaped portion 53*c* of the cylinder 53.

By having the back surface wall 2*d* constructed as mentioned hereinabove, it is possible to make the cross-sectional area being made by the inside wall surface of the arc-shaped portion 2*x* of the back surface wall 2*d* and the outside wall surface of the semicircle-shaped portion 53*c* of the cylinder 53 be equal to a cross-sectional area being formed by the inside wall of the external cylinder 2*c* and the flat portion 53*b* of the cylinder 53, thereby being constant. By this, the compressed air flowing between the outside wall of the cylinder 53 and the inside wall of the external cylinder 2*c* can be introduced to the inside of the cylinder 53 uniformly, and the compressed air flow can be made to turn 180 degrees stably on the back surface wall 2*d*. In addition, the distance "h" between the inside wall of the arc-shaped portion 2*x* of the back surface wall 2*d* and the outside wall of the semicircle-shaped portion 53*c* of the cylinder 53 (See FIG. 3.) and the radius "r" of the semicircle-shaped portion 53*c* of the cylinder 53 (See FIG. 3.) are specified in a manner that pressure loss coefficient "ζ" becomes small in the relation of the pressure loss coefficient "ζ" versus the inside diameter "D" of the combustor basket 2*a* and the cylinder 53 (See FIG. 1.).

Figure 4:
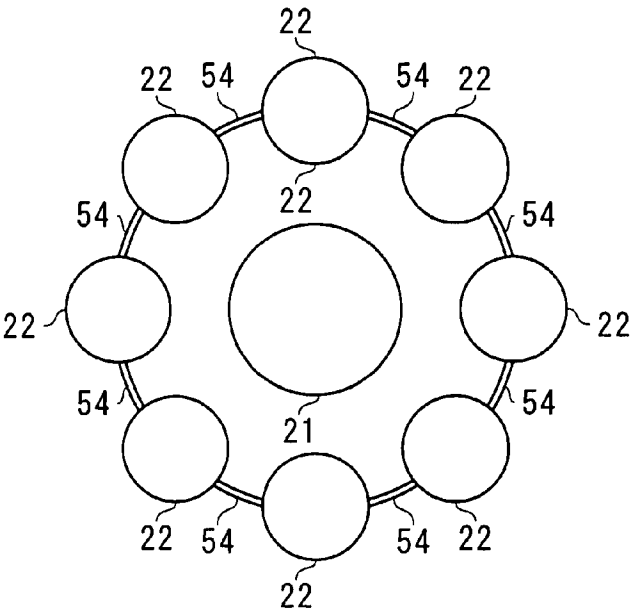
FIG. 4 is a cross-sectional view showing a relation between turning vanes and main nozzles of a combustor of FIG. 1.

Additionally, a turning vane 54 is made of a piece of plate which is bent from the outside circumference of the main nozzle 22 to the position of the axis of the main nozzle 22, in case of being viewed from the more upstream side than the cylinder 53 toward the downstream side. Then the turning vane 54 is formed so as to have the curvature thereof be equivalent to the curvature of the inside wall of the semicircle-shaped portion 53*c* of the cylinder 53. Moreover, as shown in FIG. 4, a turning vane 54 is an arc-shaped plate connecting the side surfaces of the main nozzles 22. By such turning vanes 54 constructed as described hereinabove, the compressed air being made to turn 180 degrees on the back surface wall 2*d* is introduced to the pilot cone 23 and the main burners 24. Then, by having the turning vanes 54 serve as single vanes, pressure resistance can be restrained and the compressed air can flow in a uniform manner.

By having each of the back surface wall 2*d*, the cylinder 53 and the turning vanes 54 constructed as described hereinabove, the compressed air flowing into a space between the external cylinder 2*c* and the cylinder 53 is made uniform at the tapered portion 53*a* of the cylinder 53 and subsequently, is made to turn 180 degrees at the back surface wall 2*d*, maintaining uniform flow. Then, the compressed air being made to make a turn at the back surface wall 2*d*, flowing uniformly, is uniformized by the turning vanes 54 and then introduced to the pilot cone 23 and the main burners 24. In addition, because it is possible to maintain the compressed air flow being introduced to the pilot cone 23 and the main burners 24 to be uniform, the distances from the upstream-side end of the cylinder 53 to the pilot cone 23 and the main burners 24 can be shortened, compared with a conventional construction.

(Construction of a Punched Metal Plate and Ribs)

Figure 5A:
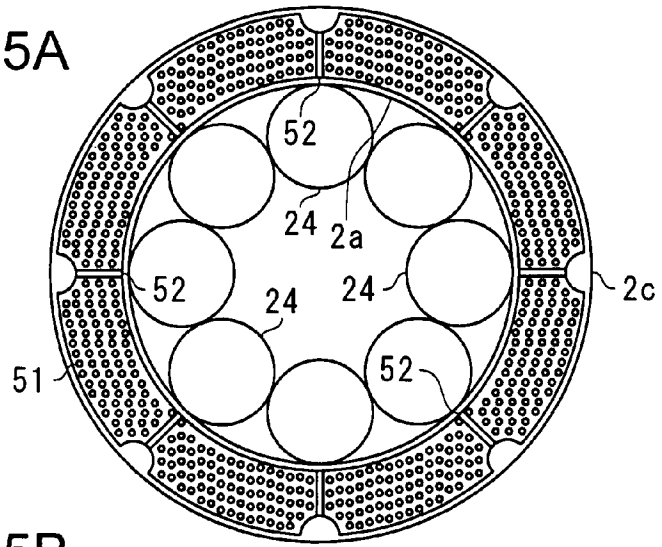
FIG. 5A is a front view seen from the upstream side of an external cylinder in a combustor of FIG. 1.

Construction of a punched metal plate 51 and ribs 52 of a combustor shown in FIG. 1 will be described hereinafter. As shown in the front view of an external cylinder 2*c* seen from the downstream side thereof in FIG. 5A, a punched metal plate 51 is constructed so as to be in a ring shape covering the entrance of the passageway of the compressed air between the outside wall of the combustor basket 2*a* and the inside wall of the external cylinder 2*c* and at the same time is constructed to be a perforated plate having a plurality of holes. Then, as shown in the front view of FIG. 5A, ribs 52 are provided in a radial pattern against the axis of a combustor in a manner that both ends of a rib 52 are in contact with the outside wall of the combustor basket 2*a* and the inside wall of the external cylinder 2*c*. Additionally, ribs 52 are provided in a plural number, and the plurality of ribs 52 are arranged so as to be equally spaced in the circumferential direction of a combustor and connected to the external cylinder 2*c*, thereby supporting the combustor basket 2*a*.

Figure 5B:
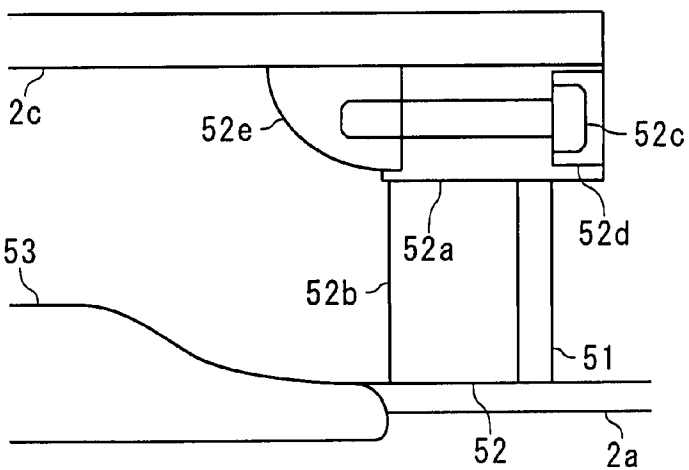
FIG. 5B is a cross-sectional view showing a periphery of a rib in a combustor of FIG. 1.

Moreover, as shown in a cross-sectional view of FIG. 5B, a rib 52 is provided with a fixing member 52*a* being connected to the outside-circumference side of a punched metal plate 51 and a plate member 52*b* being formed so as to protrude from the fixing member 52*a* to the combustor basket 2*a*, being in contact with the combustor basket 2*a*. Then, the fixing member 52*a* is constructed so as to be formed in a columnar configuration having a semicircle-shaped cross section and to be provided with a through screw hole inside thereof where a bolt 52*c* is inserted. The upstream side of the fixing member 52*a* is provided with a concave portion 52*d* where the head portion of the bolt 52*c* is embedded, and after the bolt 52*c* is inserted therein, the concave portion 52*d* is filled with a metal part, thereby forming a flat end surface.

In addition, as shown in a cross-sectional view of FIG. 5B, the external cylinder 2*c* has the inside wall thereof equipped with a rib-connecting member 52*e* which is connected to the fixing member 52*a* of a rib 52 and is formed so as to have the axial direction be approximately columnar. The rib-connecting member 52*e* is provided with a screw hole where a bolt 52*c* is inserted. As a result, a bolt 52*c* going through the screw hole of the fixing member 52*a* is inserted into the screw hole of the rib-connecting member 52*e*, which fixes the fixing member 52*a* to the rib-connecting member 52*e*, thereby, in consequence, fixing the punched metal plate 51 and the rib 52 to the external cylinder 2*c*. Moreover, by having the downstream-side end surface of the rib-connecting member 52*e* formed to be approximately semicircle curved surface, the compressed air can be prevented from being supplied with disturbance as much as possible.

By installing the ribs 52 fixed to the external cylinder 2*c* in a radial pattern as described hereinabove, the combustor basket 2*a* is pressed toward the center thereof by the ribs 52 so as to be fixed by the ribs 52. As a result, the downstream-side tips of the main nozzles 22 can be supported by the main swirls 26 in the main burners 24 being connected to the combustor basket 2*a*. Therefore, the aforementioned construction made by the back surface wall 2*d*, the cylinder 53 and the turning vanes 54, the compressed air flowing in the combustor basket 2*a* can be made uniform, which can shorten the axial lengths of the pilot nozzle 21 and the main nozzles 22. Consequently, supports being connected to the pilot nozzle 21 for supporting the downstream side of the main nozzles 22 will become unnecessary. Furthermore, by having the compressed air made uniform, resistance due to the punched metal plate 51 can be decreased, compared with the conventional construction, thereby restraining the pressure loss at the punched metal plate 51.

Second Embodiment

Figure 7:
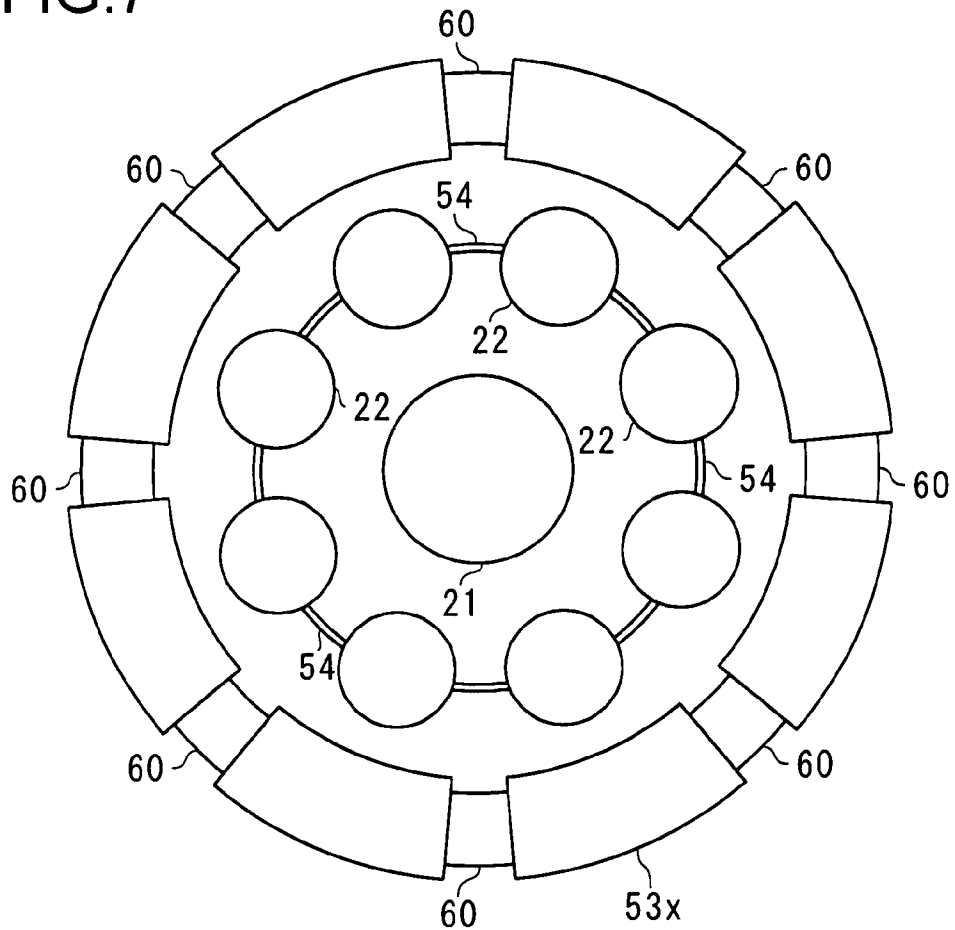
FIG. 7 is a front view showing an upstream-side tip of a cylinder shown in FIG. 6, being viewed from the base of the main nozzle.
Figure 6:
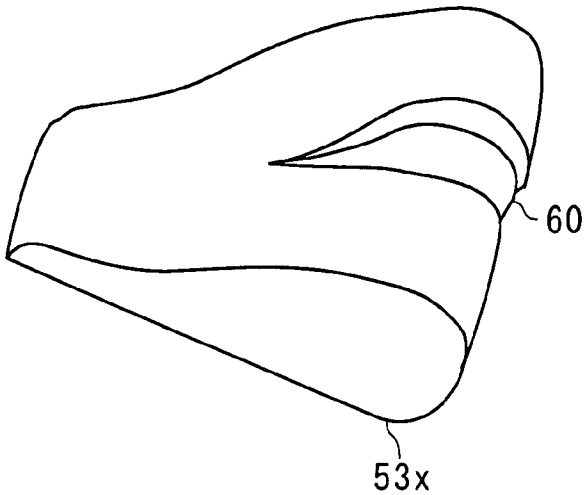
FIG. 6 is a perspective view showing a schematic construction of a part of a cylinder in a combustor in accordance with a second embodiment of the present invention.

A second embodiment of the present invention will be described hereinafter by referring to the drawings. The combustor in accordance with the present embodiment has a cylinder being provided with the side of the bases of the pilot nozzle 21 and the main nozzles 22 constructed in a different manner from the first embodiment. However, the remaining parts of the construction of the combustor with the present embodiment has a same construction as the combustor in accordance with the first embodiment. Therefore, different parts of construction of the cylinder from the first embodiment will be explained hereinafter. FIG. 6 is a perspective view showing an approximate construction of a part of a cylinder of the combustor with the present embodiment. FIG. 7 is a front view of the upstream-side end of the cylinder viewed from the side of the bases of the pilot nozzle 21 and the main nozzles 22.

Same as the cylinder 53 provided to the combustor with the first embodiment (See FIG. 2.), a cylinder 53*x* being provided to the combustor in accordance with the present embodiment comprises a tapered portion 53*a* being connected to the combustor basket 2*a*, a flat portion 53*b* where the distance to the external cylinder 2*c* is constant and a semi-circular portion 53*c* which is provided with a curved surface having a constant distance to the outside wall 2*d*. Additionally, the cylinder 53*x* has a notch 60 provided to the tip portion of a semi-circular portion 53*c* as shown in FIG. 6.

Figure 8B:
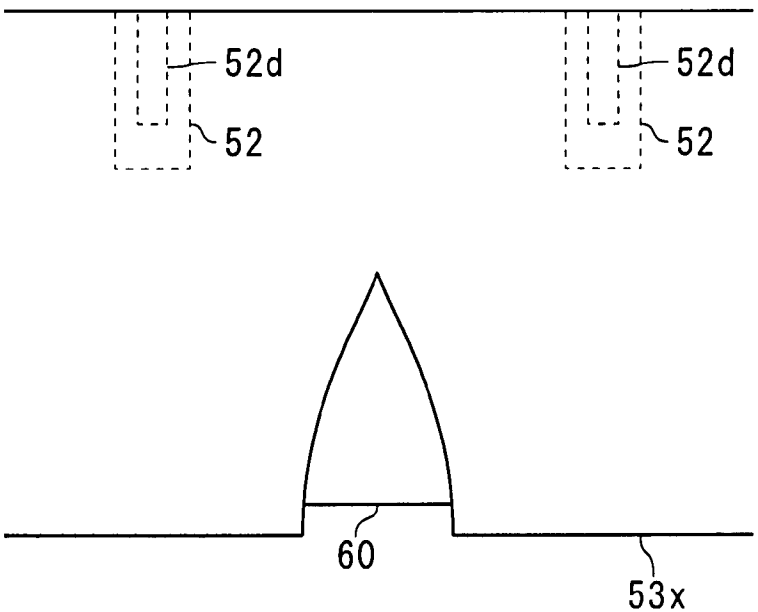
FIG. 8B is diagram showing a construction of an inside wall of a cylinder of FIG. 6.
Figure 8A:
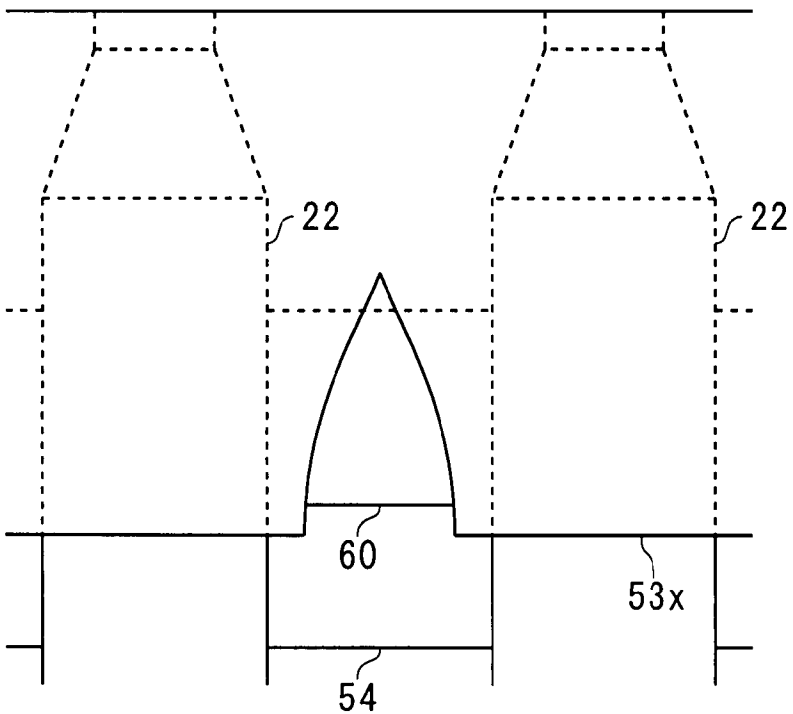
FIG. 8A is a diagram showing a construction of an outside wall of a cylinder of FIG. 6.

As shown in FIG. 7, the notch 60 is provided to a position on a radial line connecting the intermediate position of the adjacent main nozzles 22 (the position where a turning vane 54 is installed) to the center of the axis of the combustor and has the semi-circular portion 53*c* formed so as to be a groove where the surface of the notch 60 sinks more downward than the other surfaces than the notch 60. In addition, as shown in FIG. 8A, the notch 60 spreads out from the side of the combustor basket 2*a* to the end confronting the back wall surface 2*d* on the outside wall of the semi-circular portion 53*c* and also, as shown in FIG. 8B, spreads out from the side of the combustor basket 2*a* toward the end confronting the back surface wall 2*d* on the inside wall of the semi-circular portion 53*c*.

Figure 9:
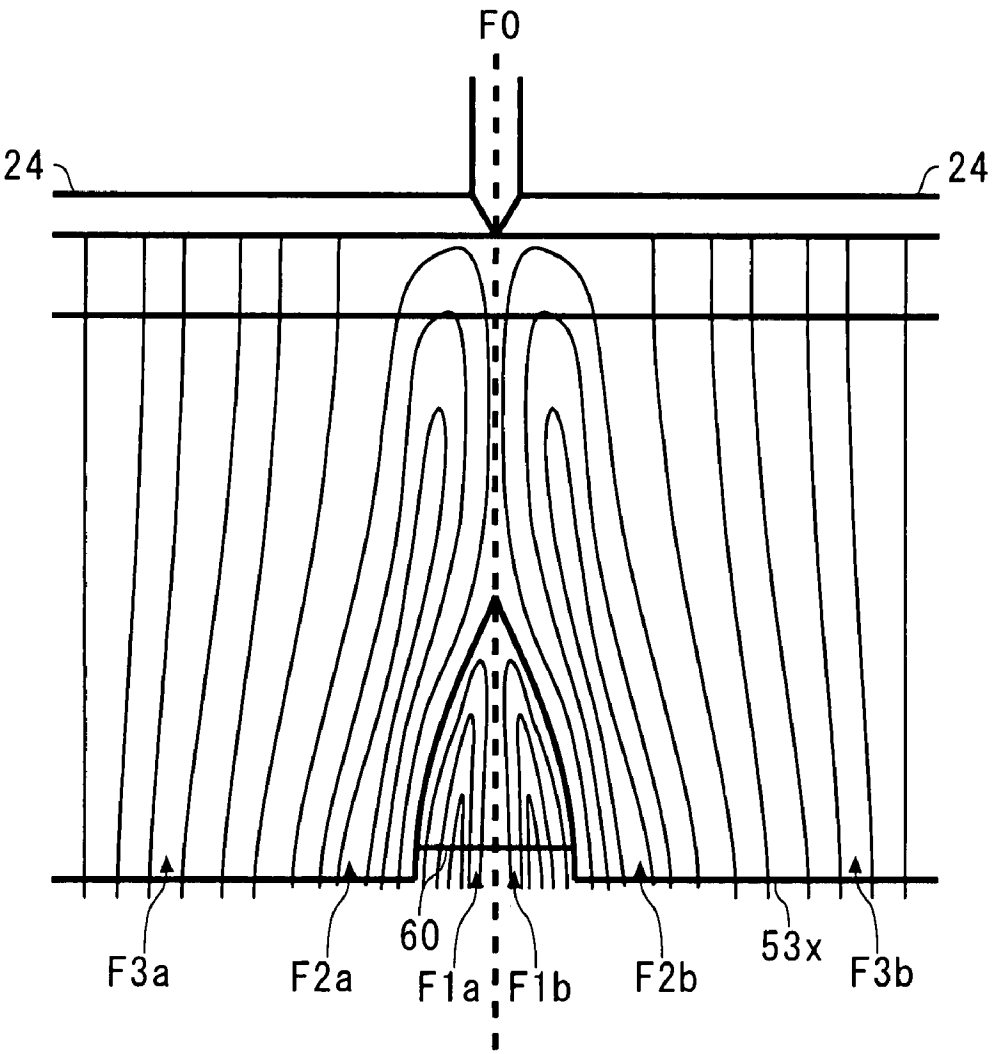
FIG. 9 is a diagram showing a flow of compressed air in a notch in a cylinder of FIG. 6.

By having the notch 60 formed as described hereinabove, the compressed air flow is formed along the notch 60. Therefore, as shown in FIG. 9, on the inside-wall side of the cylinder 2*a*, vortices F1*a* and F1*b* of the compressed air flow are formed inside the notch 60 symmetrically against the central axis F0 connecting the center position of the notch 60 to the adjacent positions of two main burners 24. Vortices F2*a* and F2*b* are formed outside the vortices F1*a* and F1*b* of the compressed air flow symmetrically against the center axis F0 in the center of the notch 60. The vortices F2*a* and F2*b* are larger than the vortices F1*a* and F1*b* and additionally, is formed along the outside of the notch 60, facing toward the main burners 24. In addition, on both sides of the vortices F2*a* and F2*b*, compressed air flow F3*a* and F3*b* are formed so as to be along the vortices F2*a* and F2*b*, flowing toward the main burners 24 that are located on both sides of the notch 60.

As observed from the compressed air flow shown in FIG. 9, by having a notch 60 formed, vortices F1*a* and F1*b* can be formed in the compressed air flow, having the absolute locations thereof at the different levels of the notch 60. Then, by the vortices F1*a* and F1*b* of the compressed air flow, the direction of the compressed air flow toward the main burners 24 can be determined. In consequence, the compressed air flow being supplied to the main burners 24 can be made uniform, thereby restraining disturbance to the compressed air flow flowing into the main burners 24.

Moreover, because pressure of the compressed air being supplied to the interior of a combustor is a high pressure, for example such as 20 Pa, the vortices F1*a*, F1*b*, F2*a* and F2*b* in the compressed air flow shown in FIG. 9 can be made small. Consequently, the vortices F1*a*, F1*b*, F2*a* and F2*b*serving as resistance and disturbance to the flow in a case of a low pressure, such as atmospheric pressure, can be made small, which not only restrains resistance and disturbance to the flow but also functions in order to determine the direction of the compressed air flow, thus giving a more favorable effect. Therefore, the compressed air flowing along the inside wall of the cylinder 53 can be made to flow to the main burners 24 more uniformly.

When a notch 60 is not provided as the first embodiment, the position of a vortex generating in the compressed air flowing to the inside of the cylinder 53 moves in the circumferential direction of the cylinder 53, so that the compressed air flow flowing into the main burners 24 are made non-uniform. On the contrary, in accordance with the present embodiment, the notch 60 is provided to the intermediate position between the main burners 24 that are adjacent to each other in the circumferential direction of the cylinder 53, so that the locations of the vortices F1*a*, F1*b*, F2*a* and F2*b* can be fixed by the notch 60. As a result, less adverse effects are given to the compressed air flow flowing into the main burners 24, thereby maintaining uniform flow as much as possible.

In the present embodiment, the notch 60 is constructed to be such as shown in FIGS. 6 through 8B. However, the notch 60 may have another configuration as long as the slot having a different level on the upstream-side end of the cylinder 53*x* (the side of the base of the main nozzle 22) is formed at an optimum position for the main nozzle 22. In addition, the notch 60 being constructed so as to have another configuration as described above is acceptable as long as the vortices F1*a* and F1*b* are formed at fixed positions in the compressed air flow flowing to the main burners 24 as shown in FIG. 9.

Figure 10:
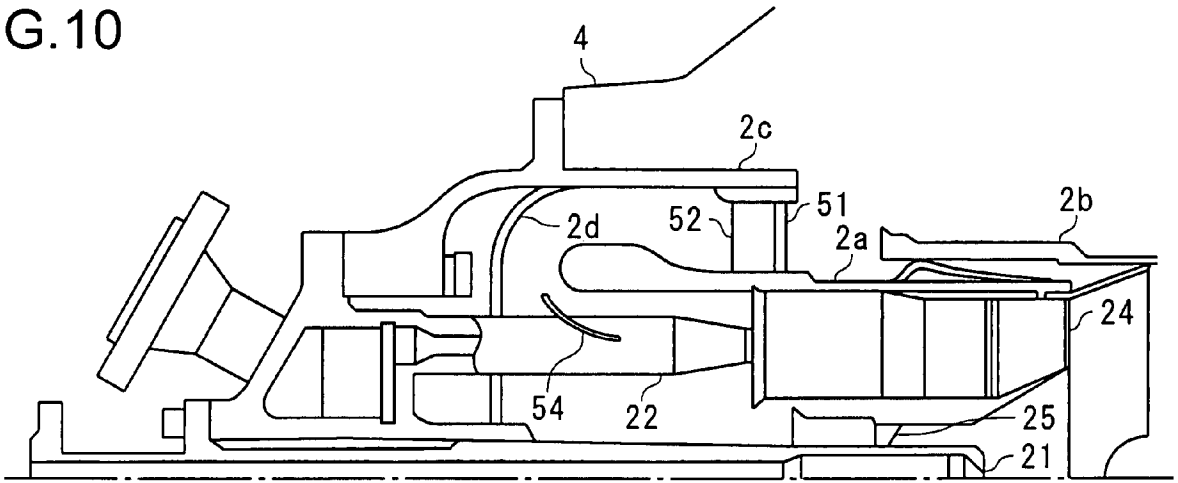
FIG. 10 is a cross-sectional view showing a construction of a combustor when a cylinder and a combustor basket are united.

Moreover, in the first and the second embodiments, the cylinders 53 and 53*x* are different components from the combustor basket 2*a*. However, as shown in FIG. 10, the upstream-side end of the combustor basket 2*a* may have a bell-mouth construction as the cylinders 53 and 53*x*. Wherein, in the case of the second embodiment, a notch 60 being provided to the cylinder 53*x* will be located at a position confronting each of the main nozzles 22.

Figure 11:
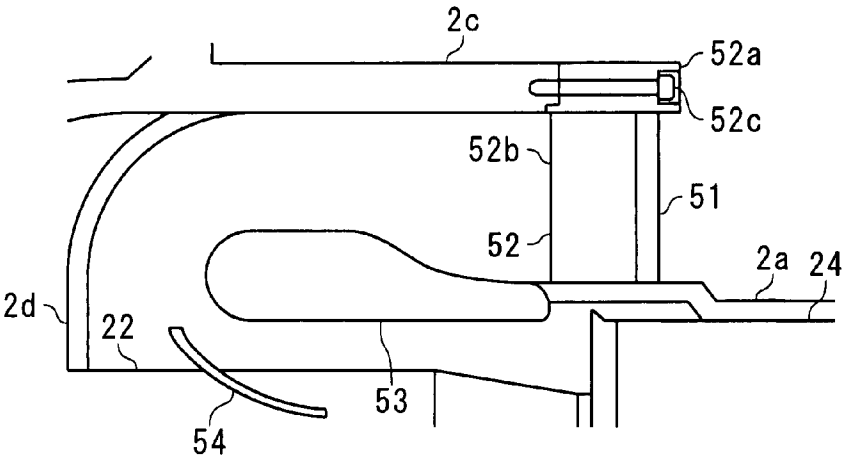
FIG. 11 is a diagram showing another example of a construction of a rib.

Furthermore, in the first and the second embodiments, as shown in FIG. 11, the inside wall surface of an external cylinder 2*c* may be positioned at the same location of the end of the fixing member 52*a* on the side of the combustor basket 2*a*, instead of providing the rib-connecting member 52*e*. Then, by providing a screw hole on an end surface on the side of the compressed air inlet of the external cylinder 2*c*, a bolt 52*c* is inserted, being through the screw hole of the fixing member 52*a*, so as to have the fixing member 52*a* fixed to the external cylinder 2*c*, thereby fixing the puched metal 51 and the ribs 52 to the external cylinder 2*c*.

What is claimed is:

1. A combustor comprising:

a pilot nozzle provided at a center of an axis of the combustor, and performing diffusion combustion;

main nozzles provided circumferentially around the pilot nozzle so as to be equally spaced with each other, and performing premixed combustion;

a combustor basket covering outside circumferences of the pilot nozzle and the main nozzles;

a cylinder connected to a first distal end, on first proximal sides of the main nozzles, of the combustor basket, having an expanding outside wall which is formed from first distal sides of the main nozzles to the first proximal sides of the main nozzles, and having a second distal end, on the first proximal sides of the main nozzles, which is formed in a semicircular cross-sectional shape;

an external cylinder provided around an outside circumference of the combustor basket and the cylinder so as to form a passageway of a compressed air between an inside wall thereof and an outside wall of the combustor basket and the expanding outside wall of the cylinder; and notches each of which is formed at tips on the second distal end of the cylinder by providing a slot which forms a step, at a position corresponding to a radial line connecting an intermediate position of an adjacent pair of the main nozzles and a center axis of the combustor, wherein the notches are grooves which are indented with respect to the other surfaces of the second distal end.

2. The combustor according to claim 1, wherein, the notches are formed from tips on a side of bases of the main nozzles of the cylinder toward inside wall of the cylinder so as to go around.

3. The combustor according to claim 2, the notches are continuously formed from the expanding outside wall of the cylinder toward the inside wall of the cylinder.

4. The combustor according to claim 3, wherein the notches are formed so as to spread toward the second distal end of the cylinder.

5. A combustor comprising:

a pilot nozzle provided at a center of an axis of the combustor, and performing diffusion combustion;

main nozzles provided circumferentially around the pilot nozzle so as to be equally spaced with each other, and performing premixed combustion;

a combustor basket covering outside circumferences of the pilot nozzle and the main nozzles;

a cylinder connected to a first distal end, on first proximal sides of the main nozzles, of the combustor basket, having an expanding outside wall which is formed from first distal sides of the main nozzles to the first proximal sides of the main nozzles, and having a second distal end, on the first proximal sides of the main nozzles, which is formed in a semicircular cross-sectional shape;

an external cylinder provided around an outside circumference of the combustor basket and the cylinder so as to form a passageway of a compressed air between an inside wall thereof and an outside wall of the combustor basket and the expanding outside wall of the cylinder; and notches each of which is formed in the second distal end of the cylinder by providing a slot which forms a step, at a position corresponding to an intermediate position between an adjacent pair of the main nozzles, wherein the notches are continuously formed from the expanding outside wall of the cylinder via the second distal end toward an inside wall of the cylinder.

* * * * *